US008283861B2

(12) United States Patent
Liu et al.

(10) Patent No.: US 8,283,861 B2
(45) Date of Patent: Oct. 9, 2012

(54) FIELD EMISSION DISPLAY

(75) Inventors: Peng Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 2 days.

(21) Appl. No.: 13/156,513

(22) Filed: Jun. 9, 2011

(65) Prior Publication Data

US 2012/0169221 A1 Jul. 5, 2012

(30) Foreign Application Priority Data

Dec. 29, 2010 (CN) ..... 2010 1 0612182

(51) Int. Cl.
*H01J 1/62* (2006.01)
*H01J 63/04* (2006.01)

(52) U.S. Cl. ..... 313/506; 313/483; 313/498

(58) Field of Classification Search ..... None
See application file for complete search history.

(56) References Cited

U.S. PATENT DOCUMENTS

| | | | | |
|---|---|---|---|---|
| 5,911,616 | A * | 6/1999 | Levine et al. | 445/52 |
| 7,012,362 | B2 * | 3/2006 | Kawate et al. | 313/495 |
| 8,110,975 | B2 * | 2/2012 | Liu et al. | 313/495 |
| 2009/0160312 | A1 * | 6/2009 | Liu et al. | 313/495 |
| 2009/0236965 | A1 | 9/2009 | Liu et al. | |
| 2012/0153808 | A1 * | 6/2012 | Yang et al. | 313/495 |
| 2012/0153809 | A1 * | 6/2012 | Yang et al. | 313/495 |
| 2012/0169212 | A1 * | 7/2012 | Liu et al. | 313/498 |
| 2012/0169222 | A1 * | 7/2012 | Liu et al. | 313/506 |

FOREIGN PATENT DOCUMENTS

| | | | |
|---|---|---|---|
| CN | 1433039 | A | 7/2003 |
| CN | 1909177 | A | 2/2007 |
| CN | 101540260 | A | 9/2009 |

* cited by examiner

*Primary Examiner* — Natalie Walford
(74) *Attorney, Agent, or Firm* — Altis Law Group, Inc.

(57) ABSTRACT

A field emission display includes an insulating substrate, a number of first electrode down-leads, a number of second electrode down-leads, and a number of pixel units. The first electrode down-leads are set an angle relative to the second electrode down-leads to define a number of cells. Each pixel unit is located in each cell and includes a cathode electrode, an electron emitter, an anode electrode, and a phosphor layer. The electron emitter is electrically connected to the cathode electrode. The anode electrode has a bearing surface inclined to the insulating substrate. The phosphor layer is located on the bearing surface.

20 Claims, 6 Drawing Sheets

FIELD EMISSION DISPLAY

CROSS-REFERENCE TO RELATED APPLICATIONS

This application claims all benefits accruing under 35 U.S.C. §119 from China Patent Application No. 201010612182.X, filed on Dec. 29, 2010 in the China Intellectual Property Office, disclosure of which is incorporated herein by reference. This application is related to applications entitled, "FIELD EMISSION DEVICE AND FIELD EMISSION DISPLAY", filed Jun. 9, 2011, Ser. No. 13/156,517; and "FIELD EMISSION DEVICE AND FIELD EMISSION DISPLAY", filed Jun. 9, 2011, Ser. No. 13/156,523.

BACKGROUND

1. Technical Field

The present disclosure relates to a field emission display.

2. Description of Related Art

Field emission displays (FED) can emit electrons under the principle of a quantum tunnel effect opposite to a thermal excitation effect, which is of great interest from the viewpoints of low power consumption.

A field emission display, according to the prior art usually includes a transparent plate, an insulating substrate opposite to the transparent plate, a number of supporters, and one or more grids located on the insulating substrate. Each grid includes a pixel unit. The pixel unit includes a first electrode, a second electrode spaced from the first electrode, at least one electron emitter connected to the first electrode, and a phosphor layer located on the second electrode. However, the phosphor layer is located on a top surface of the second electrode and has a relatively small area. Furthermore, it is difficult for the phosphor layer located on a top surface of the second electrode to be bombarded by the electron emitted from the electron emitter. Thus, the brightness of the field emission display is relatively low.

What is needed, therefore, is to provide a field emission display having relatively high brightness.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission display. In some embodiments, only one pixel unit is shown.

Figure 1:
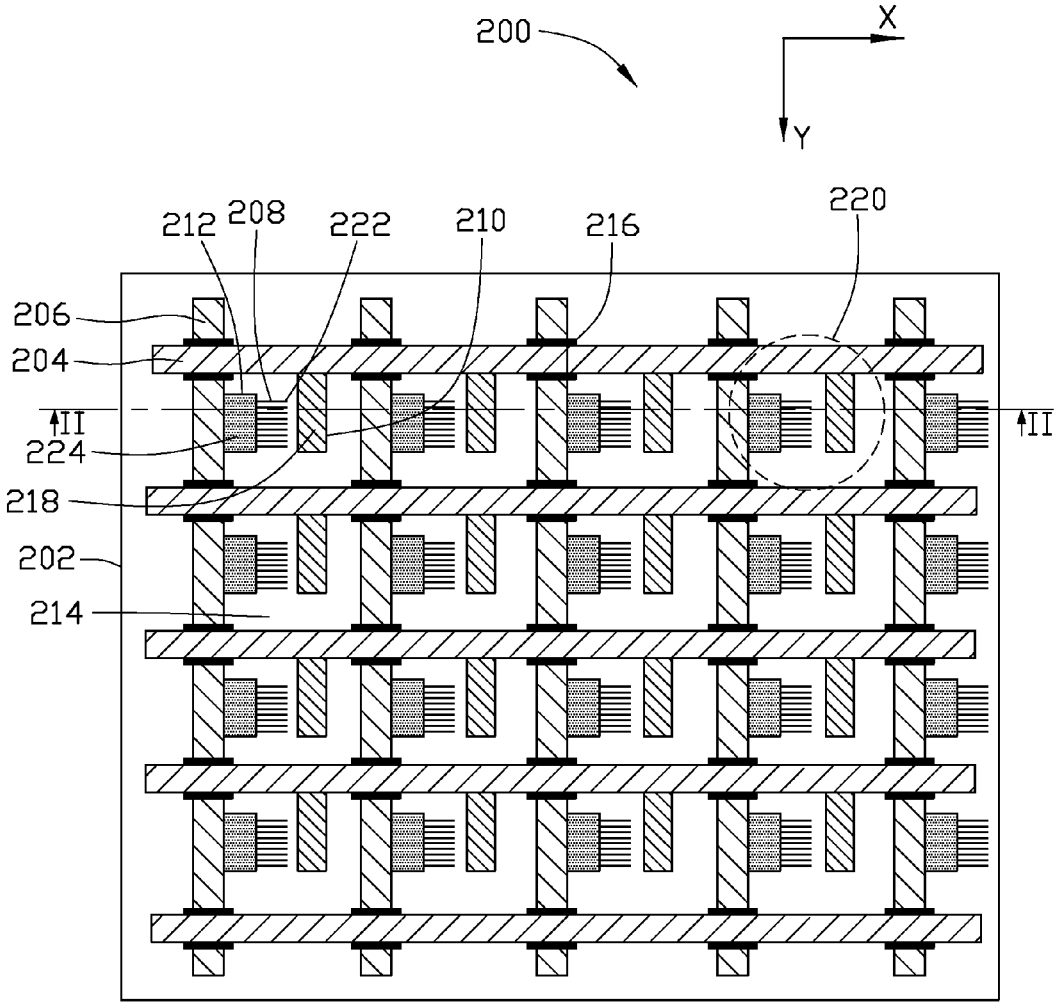
FIG. 1 is a schematic, top view of one embodiment of a field emission display.
Figure 2:
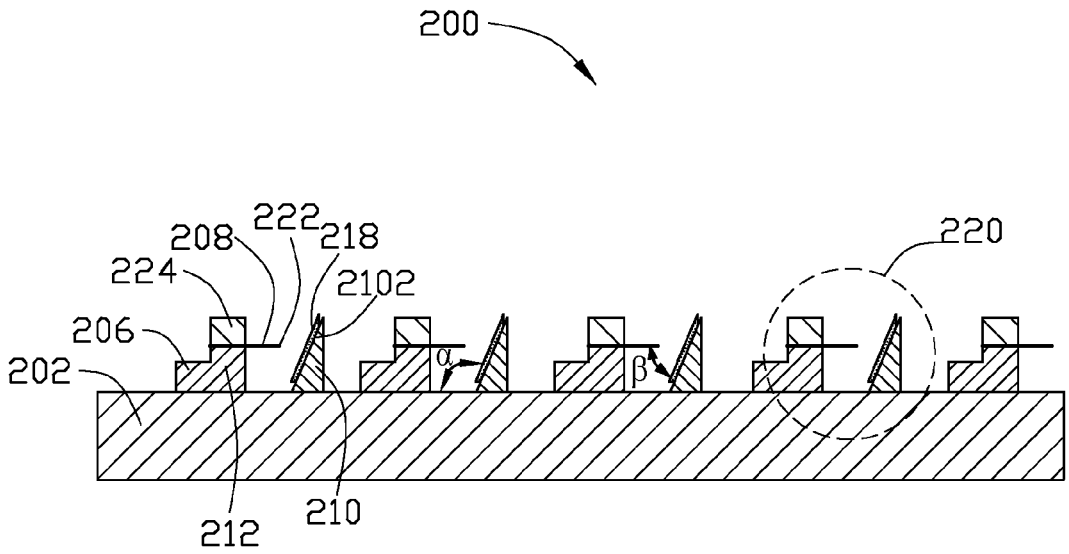
FIG. 2 is a schematic, cross-sectional view, along a line II-II of FIG. 1.

Referring to FIGS. 1 and 2, a field emission display 200 of one embodiment includes an insulating substrate 202, a number of substantially parallel first electrode down-leads 204, a number of substantially parallel second electrode down-leads 206, and a number of pixel units 220.

The first electrode down-leads 204 and the second electrode down-leads 206 are located on the insulating substrate 202. The first electrode down-leads 204 are generally set at an angle to the second electrode down-leads 206 to form a grid. A cell 214 is defined by two substantially adjacent first electrode down-leads 204 and two substantially adjacent second electrode down-leads 206 of the grid. One of the pixel units 220 is located in each cell 214. In FIG. 1, the lengthwise direction of the first electrode down-leads 204 is defined as an X direction, and the lengthwise direction of the second electrode down-leads 206 is defined as a Y direction.

The insulating substrate 202 is configured for supporting the first electrode down-leads 204, the second electrode down-leads 206, and the pixel units 220. The shape, size, and thickness of the insulating substrate 202 can be chosen according to need. The insulating substrate 202 can be made of material such as ceramic, glass, resin, or quartz. In one embodiment, the insulating substrate 202 is a square glass substrate with a thickness of about 1 millimeter and an edge length of about 1 centimeter.

The first electrode down-leads 204 are located equidistantly apart. A distance between two adjacent first electrode down-leads 204 can range from about 50 micrometers to about 2 centimeters. The second electrode down-leads 206 are located equidistantly apart. A distance between adjacent two second electrode down-leads 206 can range from about 50 micrometers to about 2 centimeters. A suitable orientation of the first electrode down-leads 204 and the second electrode down-leads 206 are set at an angle with respect to each other. The angle can range from about 10 degrees to about 90 degrees. In one embodiment, the angle is 90 degrees, and the cell 214 is a square area.

The first electrode down-leads 204 and the second electrode down-leads 206 are made of conductive material such as metal or conductive slurry. In one embodiment, the first electrode down-leads 204 and the second electrode down-leads 206 are formed by applying conductive slurry on the insulating substrate 202 using screen printing process, the conductive slurry being composed of metal powder, glass powder, and binder. The metal powder can be silver powder, the glass powder has a low melting point, and the binder can be terpineol or ethyl cellulose (EC). The conductive slurry can include about 50% to about 90% (by weight) of the metal powder, about 2% to about 10% (by weight) of the glass powder, and about 8% to about 40% (by weight) of the binder. In one embodiment, each of the first electrode down-leads 204 and the second electrode down-leads 206 is formed with a width in a range from about 30 micrometers to about 100 micrometers and with a thickness in a range from about 10 micrometers to about 50 micrometers. However, it is noted that dimensions of each of the first electrode down-leads 204 and the second electrode down-leads 206 can vary corresponding to the dimension of each cell 214.

The pixel unit 220 includes a first electrode 212, a second electrode 210, an electron emitter 208, and a phosphor layer 218. The first electrode 212 and the second electrode 210 are located on the insulating substrate 202 and spaced from each other. The first electrode 212 is used as a cathode electrode and electrically connected to the second electrode down-lead 206. The second electrode 210 is used as an anode electrode and electrically connected to the first electrode down-lead 204. The electron emitter 208 is located between the first electrode 212 and the second electrode 210, and extends from the first electrode 212 toward the second electrode 210. One end of the electron emitter 208 is electrically connected to the first electrode 212. The other end of the electron emitter 208 points to the second electrode 210 and is used as an electron emission portion 222. The electron emission portion 222 is spaced from the second electrode 210. The electron emitter 208 is suspended above the insulating substrate 202. The phosphor layer 218 is located on a surface of the second electrode 210. The electron emitted from the electron emitter 208 can bombard the phosphor layer 218 to light.

The first electrode 212 can be a planar conductor. The size of the first electrodes 212 can be selected according to the size of the cell 214. The first electrodes 212 can have a length along Y direction in a range from about 30 micrometers to about 15 millimeters, a width along X direction in a range from about 20 micrometers to 10 millimeters, and a thickness in a range from about 10 micrometers to about 500 micrometers. In one embodiment, the first electrode 212 has a length along the Y direction in a range from about 100 micrometers to about 700 micrometers, a width along the X direction in a range from about 50 micrometers to about 500 micrometers, and a thickness in a range from about 20 micrometers to about 100 micrometers.

The size of the second electrodes 210 is similar to the size of the first electrode 212. In one embodiment, the length along the Y direction of the second electrodes 210 is greater than the length along the Y direction of the first electrode 212. The thickness of the second electrodes 210 is greater than the thickness of the first electrode 212. The second electrodes 210 have a bearing surface 2102. The electron emitter 208 is oriented to the bearing surface 2102. The bearing surface 2102 can be flat or curved. If the bearing surface 2102 is flat, an angle $\alpha$ between the bearing surface 2102 and the surface of the insulating substrate 202 can be greater than 90 degrees and less than 180 degrees. In one embodiment, the angle $\alpha$ between the bearing surface 2102 and the surface of the insulating substrate 202 is in a range from about 120 degrees to about 150 degrees. If the bearing surface 2102 is curved, the bearing surface 2102 can be a convex surface or a concave surface. The bearing surface 2102 can intersect with the insulating substrate 202 or can be spaced from the insulating substrate 202. In one embodiment, the second electrodes 210 are prism shaped. The width along the X direction of the second electrode 210 decreases along a direction away from the insulating substrate 202.

The first electrode 212 and the second electrode 210 can be made of metal, indium-tin oxide (ITO), or conductive slurry. In one embodiment, the first electrode 212 and the second electrode 210 are formed by screen printing the conductive slurry on the insulating substrate 202. As mentioned above, the conductive slurry forming the first electrode 212 and the second electrode 210 is the same as the conductive slurry forming the electrode down-leads 204, 206. The first electrode 212 can be formed by screen printing once time. The second electrode 210 can be formed by screen printing or ink jeting a number of stacked conductive slurry layers repeatedly. The width along the X direction of the conductive slurry layer decreases gradually. Because of the high flowability of the conductive slurry, an incline can be formed to be used as the bearing surface 2102.

The phosphor layer 218 is located on the bearing surface 2102 of the second electrode 210 so that the phosphor layer 218 has a relative larger area and bombarded easily by the electron emitted from the electron emitter 208. Thus, the brightness of the field emission display 200 is improved. In one embodiment, the phosphor layer 218 is located on the entire bearing surface 2102 and exposed to the electron emission portion 222 of the electron emitter 208. The phosphor layer 218 can be white phosphor layer, red phosphor layer, green phosphor layer, or blue phosphor layer. The phosphor layer 218 can be formed on the bearing surface 2102 by printing, coating, or depositing. The thickness of the phosphor layer 218 can be selected according to need. In one embodiment, the thickness of the phosphor layer 218 is in a range from about 5 micrometers to about 50 micrometers.

The electron emitter 208 is a linear emitter such as silicon wire, carbon nanotubes, carbon fibers, or carbon nanotube wires. The electron emission portion 222 of the electron emitter 208 points to the bearing surface 2102. The electron emission portion 222 of the electron emitter 208 is spaced from the bearing surface 2102 by a distance in a range from about 2 micrometers to about 500 micrometers. In one embodiment, the distance between the electron emission portion 222 and the bearing surface 2102 is in a range from about 50 micrometers to about 300 micrometers. The lengthwise direction of the electron emitter 208 crosses the bearing surface 2102. An angle $\beta$ is formed between the lengthwise direction of the electron emitter 208 and the bearing surface 2102. The angle $\beta$ is greater than 0 degrees and less than or equal to 90 degrees. In one embodiment, the lengthwise direction of the electron emitter 208 is parallel to the surface of the insulating substrate 202. The angle $\beta$ is in a range from about 30 degrees to about 60 degrees. The field emitters 208 can also be carbon nanotube yarns or the multi-layer crossed carbon nanotube films.

In one embodiment, the electron emitter 208 includes a number of carbon nanotube wires evenly spaced from and in parallel with each other. The length of the carbon nanotube wires can be in a range from about 10 micrometers to about 1 centimeter. The distance between each two adjacent carbon nanotube wires can be in a range from about 10 micrometers to about 500 micrometers. One end of the carbon nanotube wire is fixed on the first electrode 212 by a fixing electrode 224 or conductive adhesive (not shown). The carbon nanotube wire can be a substantially pure structure of the carbon nanotubes, with few impurities. The carbon nanotube wire is a free standing structure.

The carbon nanotube wire includes a plurality of successive carbon nanotubes joined end to end by van der Waals attractive force therebetween. The carbon nanotubes in the carbon nanotube wire can be single-walled, double-walled, or multi-walled carbon nanotubes. The carbon nanotube wire can be untwisted or twisted. The untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. The twisted carbon nanotube wire includes a plurality of carbon nanotubes helically oriented around an axial direction of the twisted carbon nanotube wire.

In one embodiment, the electron emitter 208 is made by the steps of:

step (a), providing at least one carbon nanotube film;

step (b), placing the at least one carbon nanotube film on the first electrode 212 and the second electrode 210 to cover all the first electrodes 212 and the second electrodes 210; and step (c), breaking the carbon nanotube film to form a number of carbon nanotube wires spaced from and parallel with each other.

In step (a), the carbon nanotube film can be drawn from a carbon nanotube array. Examples of carbon nanotube film are taught by U.S. Pat. No. 7,045,108 to Jiang et al., and WO 2007015710 to Zhang et al. The carbon nanotube film includes a plurality of successive and oriented carbon nanotubes joined end-to-end by van der Waals attractive force therebetween. The carbon nanotube film is a free-standing film. The term "free-standing film" means that the film can sustain the weight of itself when it is hoisted by a portion thereof without any significant damage to its structural integrity.

In step (b), when two or more carbon nanotube films are stacked on the first electrode 212 and the second electrode 210, the aligned directions of the carbon nanotubes in two adjacent carbon nanotube films is the same. All the carbon nanotubes of the carbon nanotube film extend from the first electrode 212 to the second electrode 210. In one embodiment, less than five carbon nanotube films are stacked on the first electrode 212 and the second electrode 210.

Furthermore, the carbon nanotube films are treated with a volatile organic solvent in step (b). The organic solvent is applied to soak the entire surface of the carbon nanotube film. During the soaking, adjacent parallel carbon nanotubes in the carbon nanotube film will bundle together, due to the surface tension of the organic solvent as it volatilizes, and thus, the carbon nanotube film will be shrunk into untwisted carbon nanotube wire. The organic solvent can be ethanol, methanol, acetone, dichloroethane, or chloroform.

In step (c), the carbon nanotube film can be cut by a laser beam, an electron beam, or can be broken by heat. In one embodiment, the carbon nanotube film is cut by a laser beam. The laser beam can be moved along the first electrode down-leads 204 to remove the carbon nanotubes between the first electrode down-leads 204 and the first electrode 212. The laser beam can be moved along the second electrode down-leads 206 to break the carbon nanotubes between the first electrode 212 and the second electrode 210. The power of the laser beam can be in a range from about 10 W to about 50 W. The scanning speed of the laser beam can be in a range from about 0.1 mm/sec to about 10,000 mm/sec. The width of the laser beam can be in a range from about 1 micrometer to about 400 micrometers.

Furthermore, the field emission display 200 can include a plurality of insulators 216 sandwiched between the first electrode down-leads 204 and the second electrode down-leads 206 to avoid short-circuiting. The insulators 216 are located at every intersection of the first electrode down-leads 204 and the second electrode down-leads 206 for providing electrical insulation therebetween. In one embodiment, the insulator 216 is a dielectric insulator.

Figure 3:
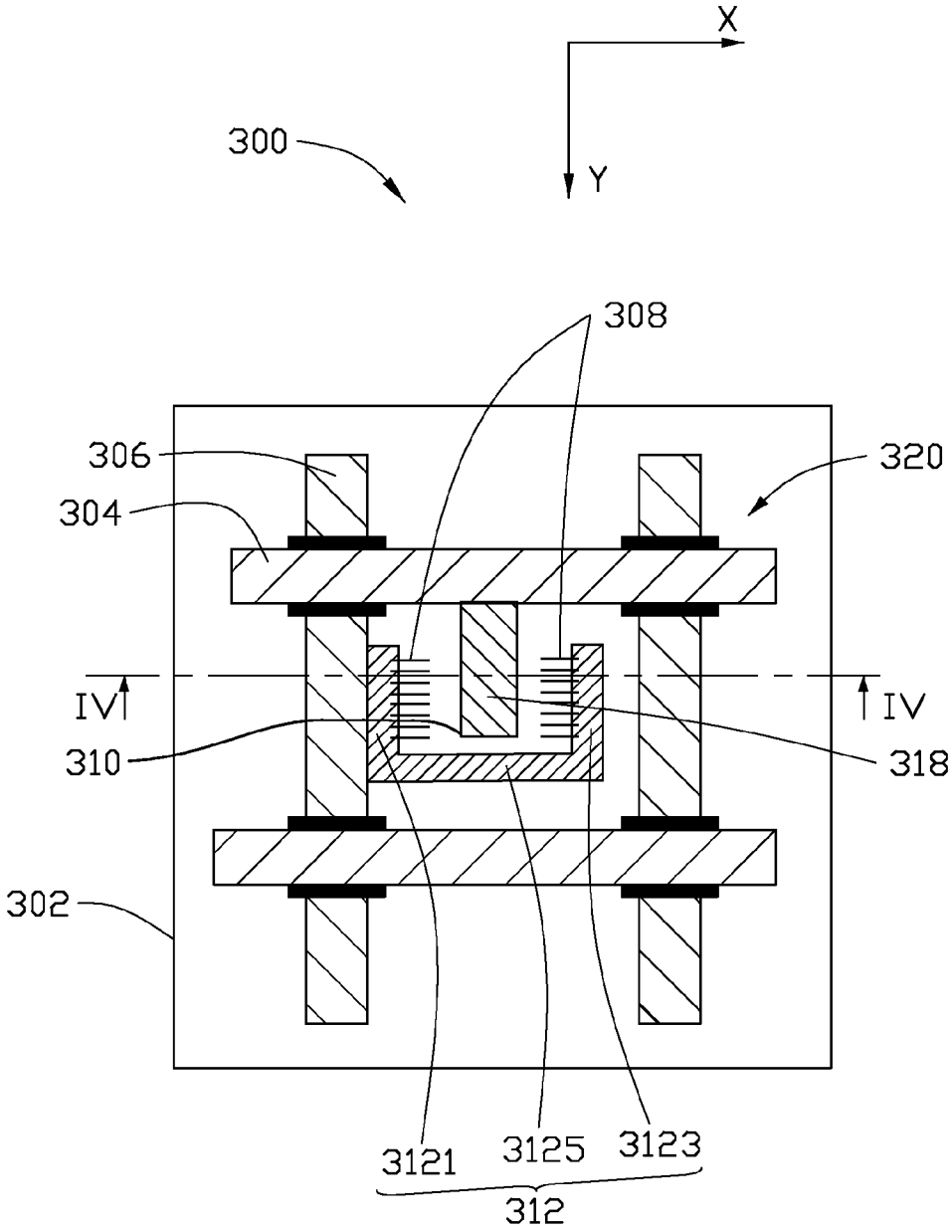
FIG. 3 is a schematic, top view of one embodiment of a field emission display.
Figure 4:
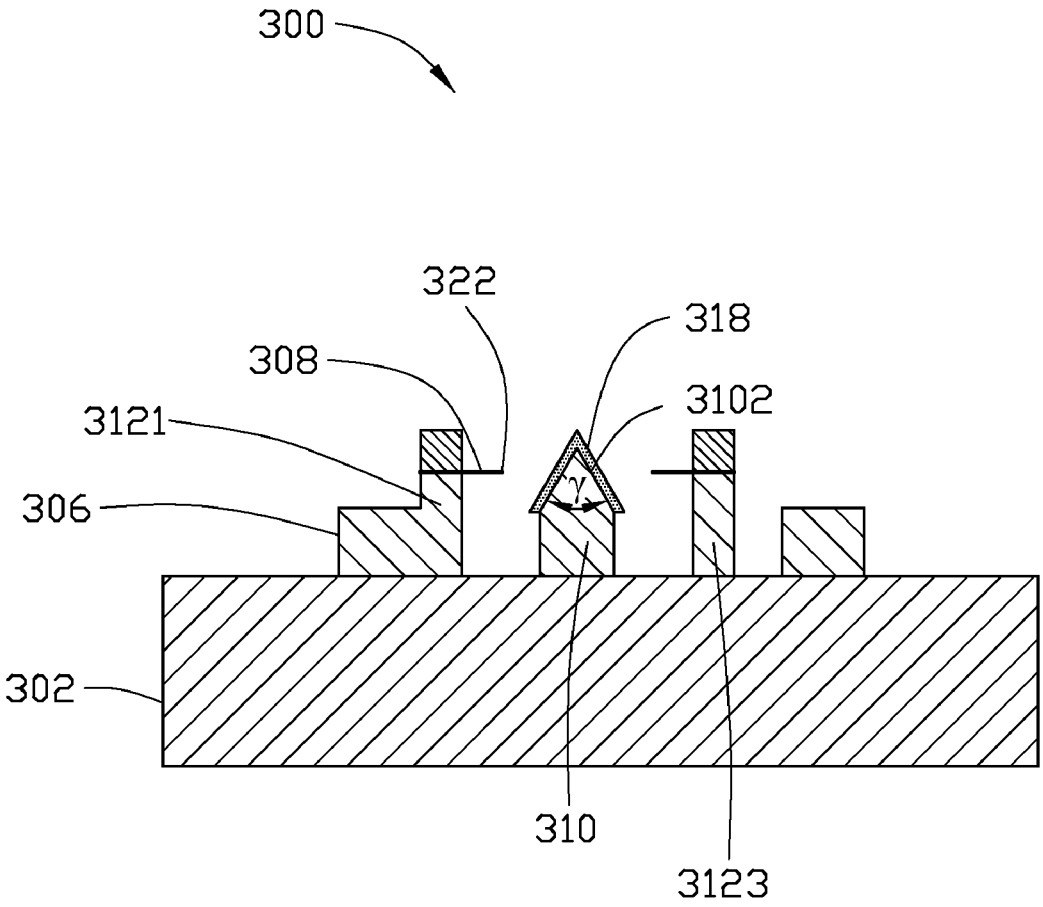
FIG. 4 is a schematic, cross-sectional view, along a line IV-IV of FIG. 3.

Referring to FIGS. 3 and 4, a field emission display 300 of one embodiment includes an insulating substrate 302, a number of substantially parallel first electrode down-leads 304, a number of substantially parallel second electrode down-leads 306, and a number of pixel units 320. In FIGS. 3 and 4, only one pixel unit 320 is shown. The field emission display 300 is similar to the field emission display 200 except that the first electrode 312 is configured to surround the second electrode 310. The first electrode 312 can be L-shaped, U-shaped, C-shaped, semicircular-shaped or ring-shaped.

In one embodiment, the first electrode 312 is U-shaped and includes a first portion 3121, a second portion 3123, and a third portion 3125. The second electrode 310 extends along the Y direction. The first portion 3121 and the second portion 3123 are located on the two sides of the second electrode 310. The third portion 3125 connects the first portion 3121 and the second portion 3123 such that the first electrode 312 surrounds the second electrode 310. Both the first portion 3121 and the second portion 3123 have electron emitters 308 located thereon. The electron emitter 308 has an electron emission portion 322 pointing to the second electrode 310. In one embodiment, the electron emitter 308 includes a number of first carbon nanotube wires connected to the first portion 3121 and extending toward the second electrodes 310. The electron emitter 308 includes a number of second carbon nanotube wires connected to the second portion 3123 and extending toward the second electrodes 310. The width along the X direction of the second electrodes 310 decreases along a direction away from the insulating substrate 302 so that the second electrode 310 has two flat bearing surfaces 3102 adjacent to and exposed to the electron emitter 308 on the two sides of the second electrode 310. The phosphor layers 318 are respectively located on the two bearing surfaces 3102 and exposed to the electron emission portion 322. The angle $\gamma$ between the two bearing surfaces 3102 can be in a range from about 30 degrees to about 120 degrees. In one embodiment, the angle $\gamma$ between the two bearing surfaces 3102 can be in a range from about 60 degrees to about 90 degrees. Because both the first portion 3121 and the second portion 3123 have electron emitters 308 located thereon, and the phosphor layers 318 are located on two bearing surfaces 3102, the brightness and uniformity of the field emission display 300 is further improved.

Figure 5:
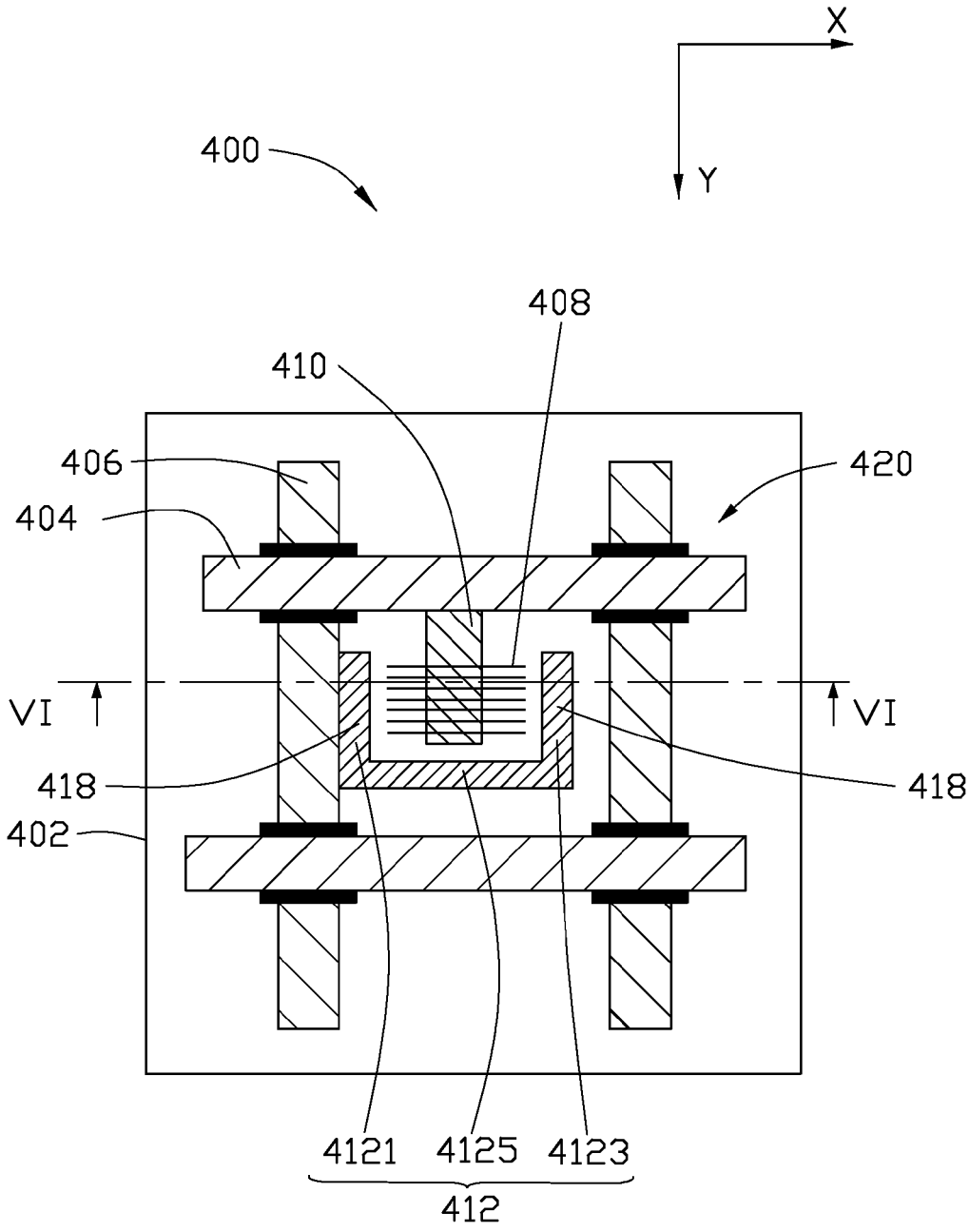
FIG. 5 is a schematic, top view of another embodiment of a field emission display.
Figure 6:
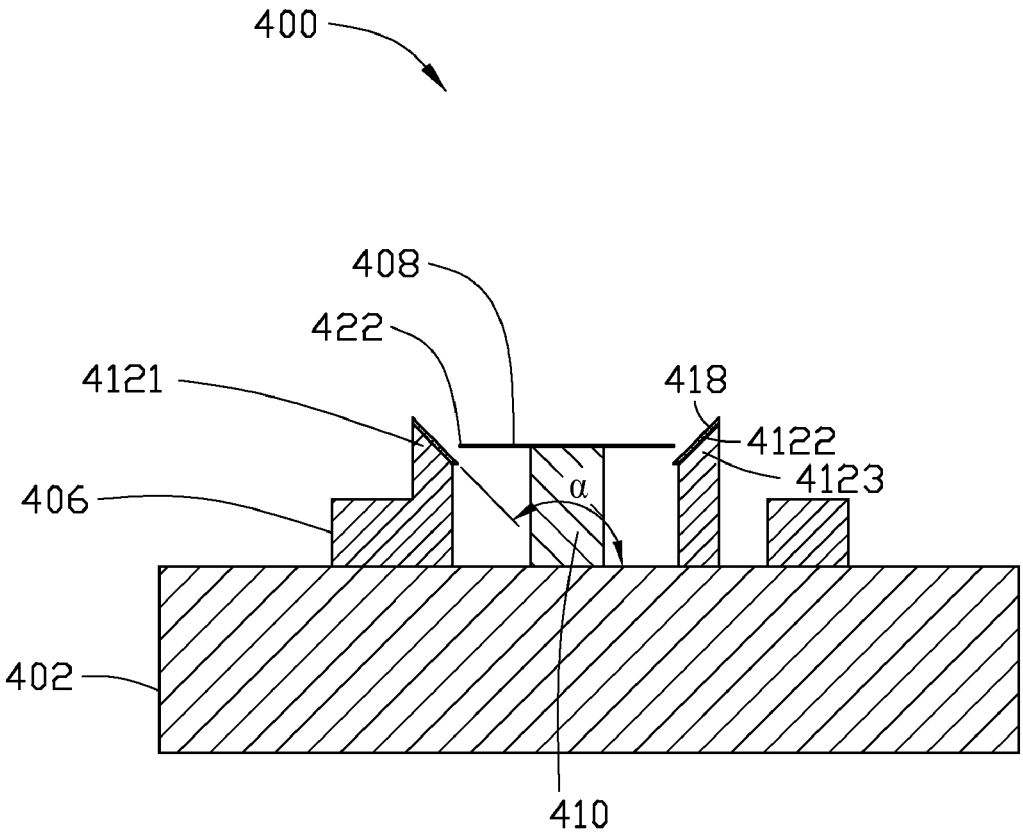
FIG. 6 is a schematic, cross-sectional view, along a line VI-VI of FIG. 5.

Referring to FIGS. 5 and 6, a field emission display 400 of one embodiment includes an insulating substrate 402, a number of substantially parallel first electrode down-leads 404, a number of substantially parallel second electrode down-leads 406, and a number of pixel units 420. In FIGS. 5 and 6, only one pixel unit 420 is shown. The field emission display 400 is similar to the field emission display 300 except that the first electrode 412 is used as anode electrode, the second electrode 410 is used as cathode electrode, the electron emitters 408 are connected to the second electrode 410, and the phosphor layers 418 are located on two bearing surfaces 4122 of the first electrode 412.

In one embodiment, the electron emitters 408 are located on a top surface of the second electrode 410. The electron emission portions 422 of the electron emitter 408 are divided into a first group and a second group. The first group of the electron emission portions 422 points to the first portion 4121. The second group of the electron emission portions 422 points to the second portion 4123. In one embodiment, the electron emitters 408 include a number of carbon nanotube wires in parallel with each other and across the top surface of the second electrode 410. The first ends of the carbon nanotube wires point to the first portion 4121 and the second ends of the carbon nanotube wires point to the second portion 4123. The width along the X direction of the first portion 4121 decreases along a direction away from the insulating substrate 402 so that the first portion 4121 has a flat bearing surface 4122 adjacent to and exposed to the electron emitter 408. The width along the X direction of the second portion 4123 decreases along a direction away from the insulating substrate 402 so that the second portion 4123 has a flat bearing surface 4122 adjacent to and exposed to the electron emitter 408. The phosphor layers 418 are respectively located on the bearing surfaces 4122 of the first portion 4121 and the second portion 4123. The angle α between the bearing surface 4122 and the surface of the insulating substrate 402 can be in a range from about 120 degrees to about 150 degrees. In one embodiment, the angle α is about 135 degrees. Because both the first portion 4121 and the second portion 4123 have bearing surfaces 4122 and phosphor layers 418 located thereon, and the electron emission portions 422 of the electron emitters 408 point to the first portion 4121 and the second portion 4123 respectively, the brightness and uniformity of the field emission display 400 is further improved.

Furthermore, the width along the Y direction of the third portion 4125 can decrease along a direction away from the insulating substrate 402 so that the third portion 4125 has a flat bearing surface 4122 adjacent to and exposed to the electron emitter 408. The electron emitter 408 can have some electron emission portions 422 pointing to the third portion 4125.

Further the field emission display 200 can include a driving circuit (not shown) to drive the field emission display 200 to display. The driving circuit can control the pixel units 220 via the electrode down-leads 204, 206 to display a dynamic image. The field emission display 200 can be used in a field of advertisement billboard, newspaper, or electronic book. In use, the field emission display 200 should be sealed in a vacuum.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads are set an angle relative to the plurality of second electrode down-leads to define a grid having a plurality of cells; and a plurality of pixel units, wherein each of the plurality of pixel units is located in each of the plurality of cells, and each of the plurality of pixel units comprises:

a cathode electrode located on the insulating substrate;

an anode electrode located on the insulating substrate and spaced from the cathode electrode, wherein the anode electrode has a bearing surface inclined to the insulating substrate;

an electron emitter electrically connected to the cathode electrode and oriented to the bearing surface; and a phosphor layer located on the bearing surface.

2. The field emission display of claim 1, wherein the bearing surface is flat, and an angle α between the bearing surface and a surface of the insulating substrate is greater than 90 degrees and less than 180 degrees.

3. The field emission display of claim 2, wherein the angle α is in a range from about 120 degrees to about 150 degrees.

4. The field emission display of claim 1, wherein the bearing surface is a convex surface or a concave surface.

5. The field emission display of claim 1, wherein a width of the anode electrode decreases along a direction away from the insulating substrate.

6. The field emission display of claim 1, wherein the electron emitter is a linear emitter having a first end fixed on the cathode electrode and a second end extending toward and spaced from the anode electrode.

7. The field emission display of claim 6, wherein the electron emitter is suspended above and substantially parallel with a surface of the insulating substrate.

8. The field emission display of claim 7, wherein a lengthwise direction of the electron emitter crosses the bearing surface, and an angle β between the lengthwise direction and the bearing surface is greater than 0 degrees and less than or equal to 90 degrees.

9. The field emission display of claim 8, wherein the angle β is in a range from about 30 degrees to about 60 degrees.

10. The field emission display of claim 1, wherein the electron emitter is silicon wire, carbon nanotube, carbon fiber, or carbon nanotube wire.

11. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads are set an angle relative to the plurality of second electrode down-leads to define a grid having a plurality of cells; and a plurality of pixel units, wherein each of the plurality of pixel units is located in each of the plurality of cells, and each of the plurality of pixel units comprises:

a cathode electrode located on the insulating substrate;

an electron emitter electrically connected to the cathode electrode;

an anode electrode located on the insulating substrate and spaced from the cathode electrode, wherein the anode electrode comprises a first portion and a second portion located on opposite sides of the cathode electrode, the first portion has a first bearing surface inclined to the insulating substrate, and the second portion has a second bearing surface inclined to the insulating substrate;

a first phosphor layer located on the first bearing surface; and a second phosphor layer located on the second bearing surface.

12. The field emission display of claim 11, wherein widths of the first portion and the second portion decrease along a direction away from the insulating substrate.

13. The field emission display of claim 11, wherein the anode electrode is U-shaped, C-shaped, semicircular-shaped, or ring-shaped.

14. The field emission display of claim 11, wherein the electron emitter comprises a plurality of first electron emission portions extending toward the first phosphor layer and a plurality of second electron emission portions extending toward the second phosphor layer.

15. The field emission display of claim 11, wherein the electron emitter comprises a plurality of carbon nanotube wires in parallel with each other, first ends of the plurality of carbon nanotube wires point to the first phosphor layer, and second ends of the plurality of carbon nanotube wires point to the second phosphor layer.

16. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads are set an angle relative to the plurality of second electrode down-leads to define a grid having a plurality of cells; and a plurality of pixel units, wherein each of the plurality of pixel units is located in each of the plurality of cells, and each of the plurality of pixel units comprises:

a cathode electrode located on the insulating substrate, wherein the cathode electrode comprises a first portion and a second portion spaced from the first portion;

a first electron emitter electrically connected to the first portion;

a second electron emitter electrically connected to the second portion;

an anode electrode located on the insulating substrate between the first portion and the second portion, and spaced from the cathode electrode, wherein the anode electrode has a first bearing surface inclined to the insulating substrate and a second bearing surface inclined to the insulating substrate;

a first phosphor layer located on the first bearing surface; and a second phosphor layer located on the second bearing surface.

17. The field emission display of claim 16, wherein a width of the anode electrode decreases along a direction away from the insulating substrate.

18. The field emission display of claim 16, wherein the cathode electrode is U-shaped, C-shaped, semicircular-shaped, or ring-shaped.

19. The field emission display of claim 16, wherein an angle between the first bearing surface and the second bearing surface is in a range from about 30 degrees to about 120 degrees.

20. The field emission display of claim 16, wherein the first electron emitter extends toward the first bearing surface and the second electron emitter extends toward the second bearing surface.

* * * * *